United States Patent [19]

Phelps

[11] 4,408,394

[45] Oct. 11, 1983

[54] DISASSEMBLABLE JACK KNIFE

[76] Inventor: Paul S. Phelps, 1306 Woodlawn Dr., Maryville, Tenn. 37018

[21] Appl. No.: 346,725

[22] Filed: Feb. 8, 1982

[51] Int. Cl.[3] ..... B26B 5/00

[52] U.S. Cl. ..... 30/157; 30/339

[58] Field of Search ..... 30/155, 156, 157, 339

[56] References Cited

U.S. PATENT DOCUMENTS

| | | | |
|---|---|---|---|
| 903,709 | 11/1908 | Guthrie | 30/157 |
| 1,014,927 | 1/1912 | White | 30/157 |
| 1,182,043 | 5/1916 | Schless | 30/157 |
| 2,977,678 | 4/1961 | Swinden | 30/155 |
| 3,061,927 | 11/1962 | Ludwigsdorf | 30/156 |
| 4,161,818 | 7/1979 | Phelps | 30/157 |
| 4,218,819 | 8/1980 | Phelps | 30/157 |

FOREIGN PATENT DOCUMENTS

| | | | |
|---|---|---|---|
| 227823 | 6/1925 | United Kingdom | 30/157 |
| 369388 | 3/1932 | United Kingdom | 30/157 |

*Primary Examiner*—Jimmy C. Peters

*Attorney, Agent, or Firm*—Pitts, Ruderman & Kesterson

[57] ABSTRACT

A jack knife which may be disassembled with a minimum of tools for purposes of cleaning the interior, changing blades or the like. The knife has a pair of liner side plates encasing a backspring and thereby providing a compartment for receiving a knife blade. Each of the side plates has a slot of nonuniform width near the head end for receiving an annularly grooved pin. This pin also passes through the head end of the backspring. A pivot through the back-spring engages a cooperative pair of apertures in the side plates and provides a pivot for the rotation of the side plates with respect to each other when disassembly is desired. A blade pivot member passes through one side plate and through an opening in the tang of the knife blade and thence is suitably engaged with the second side plate. Additional apertures in the side plates at a position corresponding to the blade walk edge of the forward portion of the backspring are provided to receive a pointed tool which causes the backspring to be disengaged from the tang of the knife blade. This disengagement permits the removal of the knife blade after the removal of the blade pivot member. The side plates may be externally provided with conventional end bolsters and caps, as well as a decorative insert, on the handle. The pointed tool for disassembling may be a simple pointed nail or the like.

10 Claims, 6 Drawing Figures

DISASSEMBLABLE JACK KNIFE

DESCRIPTION

1. Technical Field

This invention relates to folding knives, often referred to as pocket knives, and more particularly to jack knives having means for the disassembly of the knife for cleaning or replacement of parts thereof and the like.

2. Background Art

Several knives are known in the art which are designed for disassembly. One such knife is that described in U.S. Pat. No. 3,061,927, issued Nov. 6, 1962, to O. von Frankenberg und Ludwigsdorf. In that knife, a screw holding the blade is removable after a lever applying pressure to one or more springs is rotated to relieve that pressure upon the knife blade. The internals, i.e., spring, lever and blade can then be removed. However, the liner side pieces remain in their spaced relationship due to transverse rivets. Thus, the interior of the knife case cannot be fully cleaned.

Another knife is that disclosed in a patent issued to the present inventor entitled "Folding Pocket Knife Having Replaceable Blades". This knife described in U.S. Pat. No. 4,161,818 issued July 24, 1979, has a set screw passing through the lock type backspring. After removal of the screw and the backspring, rotary motion of a second spring disengages lock pins permitting even the liner side plates to be removed. While only one tool is required for the disassembly operation, namely, an allen wrench for the removal of the set screw, that tool might not always be available when disassembly is desired.

Still another knife designed for the disassembly of the parts thereof is described in U.S. Pat. No. 4,218,819 issued to the present applicant on Aug. 26, 1980. In the construction of this knife the liner side plates, which form the cavity for a knife blade when the blade is in a closed position, are provided with a slot of nonuniform width near each end. Annularly grooved pins fit in each of the aligned sets of slots. A backspring is positioned between the side plates, and a pivot therethrough engages cooperative holes in the side plates. One of the grooved pins passes through a circular opening in the tang of a blade, that pin being a pivot for the blade. A locking cam unit is provided at the end opposite the blade which, when rotated in one direction, locks the grooved pins in the slots and tensions the backspring against the blade tang. Rotation of the locking cam unit in the opposite direction unlocks the pins, removes the spring force, and thereby permits the liner side plates to be moved apart whereby all parts are disengaged and separable for cleaning and/or replacement. This knife, although not requiring any tools for disassembly, does require careful alignment of the components, namely, the pins and the slots, together with the requirement of the fabrication of the cam unit for the locking and unlocking operation.

Accordingly, it is one object of the present invention to provide a jack knife construction which permits the disassembly of the components in a manner simpler than in the knives of the known prior art.

It is a further object to provide a jack knife wherein the liner side plates thereof are provided with aligned apertures adjacent the position of an edge of the backspring in proximity to the knife tang, i.e., the blade "walk", whereby an object inserted through these aligned apertures removes the force of the backspring from the blade tang.

It is another object of the present invention to utilize a simple threaded member which passes through a bushing inserted into the knife tang for the securing of a knife blade between the liner side plates thereof.

It is yet another object of the present invention to provide cooperating slots of nonuniform width in the liner side plates at the end opposite the blade-mounting end to receive an annularly grooved pin passing therethrough and through the corresponding end of the backspring of the knife. This grooved pin and nonuniform slots permit the separation of the liner side plates, when the knife blade has been removed from the opposite end of the side plates, by the rotation of the side plates about a pivot pin provided for the backspring.

Other objects of the present invention will become apparent upon a consideration of the drawings and the description thereof which follows.

DISCLOSURE OF THE INVENTION

In accordance with the invention, a pair of parallel liner side plates encompass at least one backspring along one edge of the side plates, with a pivot for the backspring passing through corresponding apertures in the side plates. One end of each liner side plate is provided with an aperture for the receipt of a removable blade-holding element which may be threadably engaged with one of these apertures. The opposite end of each of the side plates is provided with a corresponding slot having a nonuniform width; these slots adapted to receive an annularly grooved pin for the releasable joining of the liner side plates at a spaced distance corresponding to the thickness of the backspring. Furthermore, each liner side plate is provided with an additional aperture positioned appropriately adjacent the blade walk edge of a backspring encased by the side plates whereby an object passing through these additional apertures causes the backspring to be raised from its normal position whereby the backspring blade walk will not be engaged with a tang of a blade disposed between the liner side plates. Conventional bolsters, caps and decorative handles may be provided on the exterial surfaces of the liner side plates of this knife.

BEST MODE FOR CARRYING OUT THE INVENTION

Figure 1:
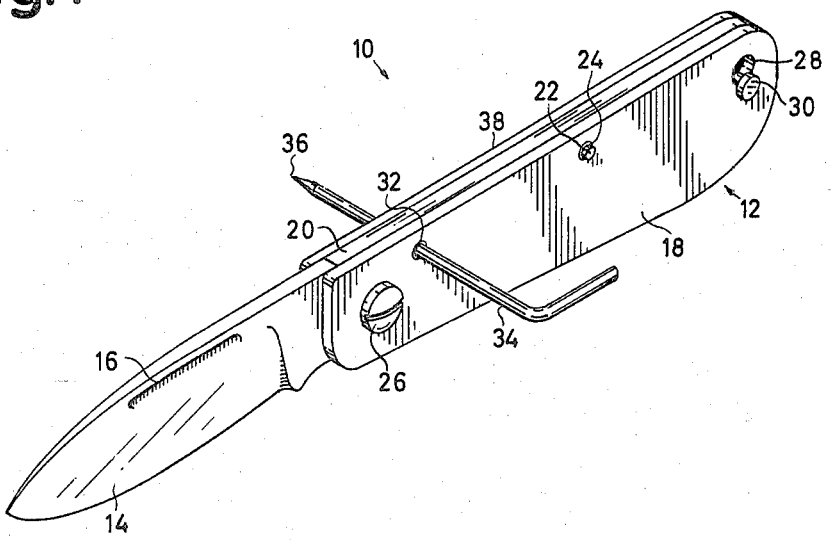
FIG. 1 is an isometric drawing of the present invention showing the components thereof without the addition of the external bolsters, caps and decorative handles, but showing the element or tool utilized to remove backspring pressure from any blade contained within the knife.

Referring now to FIG. 1, the present invention is generally illustrated at 10. It consists generally of a handle portion 12 and a knife blade 14. Since any blades thereof are located only at one end, it is termed a "jack knife". This blade 14 may be provided with an elongated groove 16 to assist in the movement of the blade 14 from within a recess (not shown) in the handle unit 12. The particular blade shown herein is known as a finger skinner. However, a blade of another configuration, e.g., a drop point skinner or of other configurations can be substituted as described hereinafter. The handle portion consists principally of a pair of liner side plates 18, 38 which encase a single ended or "head" backspring 20. A backspring pivot 22 engages with corresponding apertures 24 in the liner side plates 18, 38. A removable blade pivot element, such as a threaded machine screw 26, passes through the side plate 18 and the tang of the blade 14 to be received within the opposite liner side plate 38. At the opposite (head) end of each of liner side plate are slots 28 of nonuniform width, e.g., key hole shaped, which receive an annularly grooved pin 30. Adjacent the blade pivot member 26 each of the side plates 18, 38 is provided an aperture 32 which is positioned adjacent the blade walk edge of the backspring which edge contacts the tang of the blade 14 (see FIG. 3). Although the aperture 32 is shown having a circular cross-section, other cross-section configurations can be utilized. An unlocking element or tool 34 is provided which may be passed through the aperture 32 and the corresponding aperture in liner plate 38 to disengage the backspring 20 from the blade tang. The extreme end 36 of the unlocking tool 34 is generally pointed to assist in the insertion of this tool through the aperture 32 and past the blade walk edge of the backspring 20.

Figure 2:
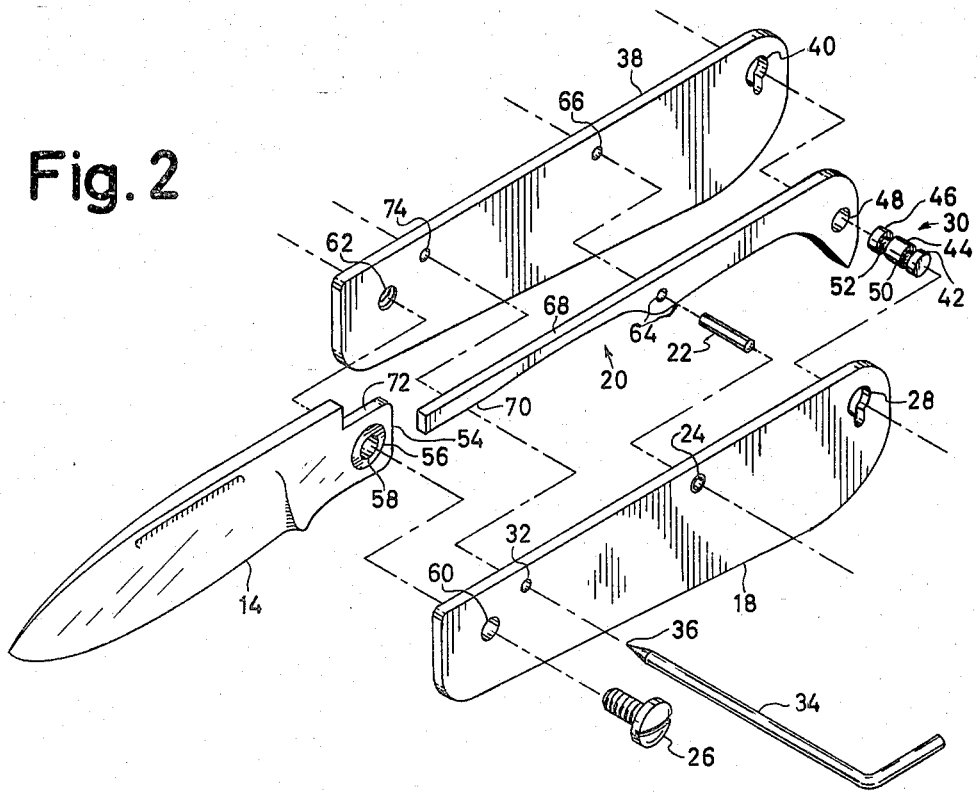
FIG. 2 is an exploded view of the jack knife of FIG. 1 showing the parts thereof.

The construction of the present invention is further illustrated in the exploded view shown in FIG. 2. In this view, the second liner side plate 38 is shown to be substantially identical to side plate 18 which was seen in FIG. 1. It may be seen that the second side plate 38 is provided with a corresponding elongated slot 40 having an identical configuration to the slot 28 in side plate 18. These slots 28 and 40 receive the aforementioned grooved pin 30. This pin, in this embodiment, has three enlarged portions 42, 44 and 46 of a diameter to be received by the enlarged portion of the aforementioned slots 28, 40 as well as a corresponding aperture 48 in the head end of the backspring 20. The portions of smaller diameter, namely, grooves 50 and 52, of the pin 30 are sized to fit the smaller portion of the slots 28 and 40 for the purpose described in detail hereinafter. The width of the grooves 50, 52 correspond to the thickness of the liner side plates 18, 38, and the width of the central enlarged portion 44 of the pin 30 corresponds to the thickness of the backspring 20.

It may be seen that the knife blade 14 is provided with a conventional tang 54 (a square tang is illustrated). This tang 54 preferably has a bushing 56 inserted therein which is provided with an aperture 58. This aperture 58 is designed to receive the aforementioned blade pivot member 26 which passes through an aperture 60 in side plate 18 and then into aperture 62 of side plate 38. If desired, the aperture 62 may be provided with internal threads for the threadable engagement with corresponding threads on pivot member 26.

The backspring 20 is designed to be interposed between the liner side plates 18 and 38. The aforementioned backspring pivot 22 is carried within aperture 64 in the backspring 20 and engages with aperture 24 in side plate 18 and aperture 66 in side plate 38. Further, the backspring 20 has a finger portion 68 extending toward the blade tang 54. The blade walk edge 70 of this finger portion of the backspring normally engages a surface 72 of the tang 54 when the blade 14 is in the open position. However, when the tool 34 is inserted through aperture 32 in side plate 18, and through an aperture 74 in side plate 38, the pointed end 36 thereof moves the backspring finger 68 in an upward direction in this figure. Thus, the blade walk edge 70 no longer contacts the tang surface 72. In order that this passage of the tool 34 may be accomplished and the backspring moved, the aligned apertures 32 and 74 are positioned whereby these apertures are substantially intercepted, e.g., bisected, by the blade walk edge 70 of the backspring portion 68.

Figure 3A:
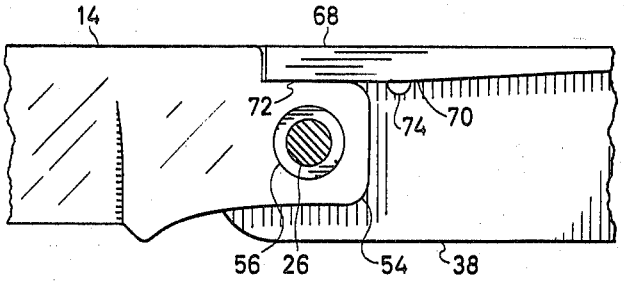
FIG. 3 is a fragmentary cut away drawing showing, in FIG. 3A, the normal relationship of a backspring to a tang of a knife blade; and in FIG. 3B, the change in this relationship through the use of a pressure-relieving component inserted transversely to the backspring.
Figure 3B:
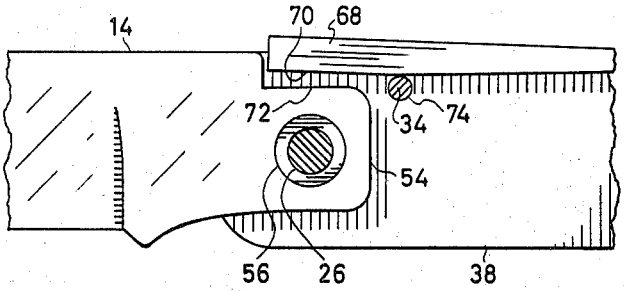

This construction is more clearly viewed in FIG. 3. In FIG. 3A, for example, it may be seen that the blade walk edge 70 of the backspring finger 68 is normally in contact with the surface 72 of the blade tang 54. When in this position, the aperture 74 in liner side plate 38 is substantially bisected by this edge 70. However, as shown in FIG. 3B, when the tool 34 is inserted through the aperture 74, the finger portion 68 of the backspring is moved whereby the blade walk edge 70 no longer contacts the surface 72 of the blade tang 54. With the backspring finger 68 elevated in this manner, the blade pivot member 26 may be removed from the bushing 56 whereby the blade 14 may be fully removed from the knife. It should be pointed out that the blade is in the extended or open position for this removal operation.

The disassembly procedure for the knife is as follows. The initial step is to pivot the knife blade 14 about the pivot member 26 so as to be in an extended position as shown in FIG. 1. Thereafter, the tool 34 is inserted through the aperture 32 in the liner plate 18 and the corresponding aperture 74 on the reverse side of the knife. As shown in FIG. 3, the insertion of this tool 34 raises the backspring finger 68 such that the blade walk 70 thereof no longer contacts the surface 72 of the knife blade tang 54. The pivot member 26 may then be removed using a screw driver or any suitable item.

Upon complete removal of the pivot member 26, the blade 14 may be removed from the knife handle 12. Thereafter, the tool 34 is removed from the knife handle. This permits the side plates to be rotated with respect to each other about the backspring pivot pin 22 (see FIG. 2). This rotation brings about the disengagement of the grooved pin 30 from the slots 28 and 40 thereby permitting the separation of the liner side plates 18 and 38 from each other, and the disengagement thereof from the backspring 20. Accordingly, all of the components of the knife are available for cleaning or the replacement as parts as needed. Typical of such replacement is the substitution of a different type of blade 14 for use with specific applications of the knife of the subject invention.

Figure 4:
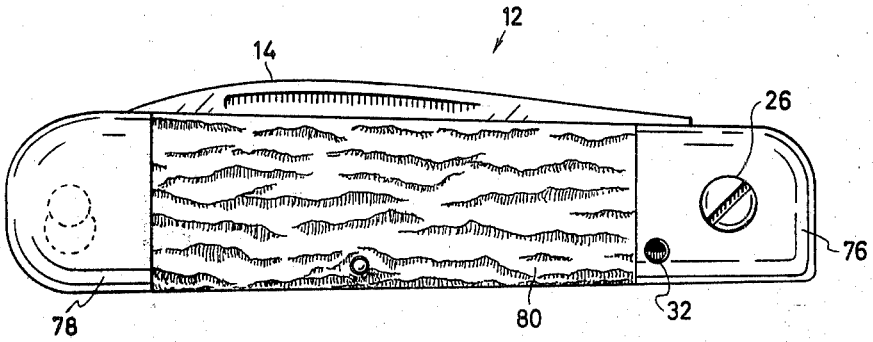
FIG. 4 is a plan view of the jack knife of the present invention as shown in a closed position with conventional bolsters, caps and decorative handle attached thereto.

Although the essential components of the knife have been illustrated and described above, a pocket knife normally is provided with end bolsters, caps and a decorative handle. This construction is illustrated in FIG. 4. As shown from one side, the knife handle 12 has a forward bolster 76 which may be attached to the aforementioned liner side plate 18 in any suitable manner, e.g., with screws from the reverse side of the liner plate. Furthermore, the knife has a rearward or head cap 78. It will be understood that corresponding forward bolster and head cap are provided on the opposite side of the knife as attached to side plate 38 (see FIG. 2). Interposed between the forward bolster 76 and the head cap 78 is a decorative handle insert 80 attached in an appropriate manner to the side plate 18, 38. 38. In this particular embodiment, the aperture 32 for the receipt of the tool 34 is provided through the forward bolster 76. In an alternate construction, depending upon the size of the bolster 78 and the desired position of the aperture 32, this aperture 32 may extend through the handle insert 80 instead of through the bolster 76. The pivot member 26 passes through bolster 76 and may, if desired, threadably engage the bolster (not shown) on the opposite side of the knife rather than with the second liner side plate. Disassembly is the same as described above.

From the foregoing description, it will be recognized that a jack knife is provided that may be easily disassembled for the replacement of parts or for the individual cleaning thereof. The tool 34 may be any suitably pointed object, including a small nail, which a user may carry or may secure at many remote locations. Furthermore, if desired, provision could be made within the handle 12 for the carrying of this tool with the knife. The construction provides for simple manufacture, is reliable, and is adapatable for knives of many sizes. Furthermore, a multi-bladed jack knife may be manufactured utilizing the same principles as herein described. The only additional components to accommodate additional blades is the inclusion of a separate backspring for each blade. The annularly grooved pin would be modified to accomodate the extra components. In addition, the slots 28, 40 may have configurations other than key shaped. Any configuration that will permit passage of the pin 30 through the wider portion of the slot and yet engage the grooves of the pin with the narrower portion, is acceptable.

It is, of course, understood that although a preferred embodiment of the present invention has been illustrated and described, various modifications thereof will become apparent to those skilled in the art. Accordingly, the scope of the invention should only be defined by the appended claims and the equivalents thereof.

I claim:

1. A jack knife adapted for disassembly with a pointed rod-like tool, which comprises:

a pair of spaced apart symmetrical liner plates having a blade end and a head end, each of said liner plates being provided with a blade pivot pin receiving aperture at said blade end, a slot of nonuniform width having a maximum width portion and a minimum width portion at said head end, and an aperture intermediate said pivot aperture and said slot to receive a backspring pivot;

at least one head backspring interposed between said liner plates along one edge thereof, said backspring having a blade walk portion and a head portion and being provided with a pivot pin aperture corresponding to said backspring pivot pin apertures of said liner plates, and with an aperture in said head portion corresponding to said maximum width portion of said slots in said liner plates;

at least one knife blade having a tang thereof interposed between said liner plates, said tang being provided with a blade pivot pin aperture, said tang bearing against said blade walk portion of said backspring;

a removable blade pivot pin passing through corresponding blade pivot pin apertures of said liner plates and said pivot pin aperture of said tang;

a backspring pivot pin passing through said backspring pivot pin apertures in said backspring and said liner plates;

a cylindrical locking pin penetrating said aperture of said head portion of said backspring and said nonuniform slot of said liner plates, said pins being provided with annular grooves with releasable engagement with said minimum width portions of said slots; and wherein said liner plates are further provided with aligned tool-receiving apertures to permit passage of said tool through said liner plates, said tool-receiving apertures positioned such that said blade walk of said backspring intercepts said tool-receiving apertures.

2. The jack knife of claim 1 further comprising a bushing inserted into said blade pivot pin aperture of said tang.

3. The jack knife of claim 1 wherein said blade pivot pin passes through one of said liner plates and is threadably engaged with said second of said liner plates.

4. The jack knife of claim 1 wherein said blade walk portion of said backspring substantially bisects said tool-receiving apertures of said liner plates.

5. The jack knife of claim 1 wherein said tool-receiving apertures are substantially circular in cross-section.

6. The jack knife of claim 1 further comprising a first and second handle portion attached to exterior surfaces of said liner plates.

7. The jack knife of claim 6 wherein said blade pivot pin passes through said first handle portion and said pivot pin apertures of said liner plates and said tang, and is threadably engaged with said second handle portion.

8. The jack knife of claim 6 wherein said handle portions are each provided with a tool receiving aperture aligned with said tool receiving apertures of said liner plates.

9. The jack knife of claim 6 wherein each of said handle portions comprises: a bolster at said blade end; a cap at said head end; a decorative insert therebetween; and wherein said blade pivot pin passes through one of said bolsters and is threadably engaged with the second of said bolsters.

10. The jack knife of claim 9 wherein said bolsters are each provided with a tool receiving aperture aligned with said tool receiving apertures of said liner plates.

* * * * *